US012503802B2

(12) United States Patent
Blömer et al.

(10) Patent No.: US 12,503,802 B2
(45) Date of Patent: Dec. 23, 2025

(54) WASHING MACHINE AND METHOD FOR WASHING TEXTILES

(71) Applicant: Fraunhofer-Gesellschaft zur Förderung der angewandten Forschung e.V., Munich (DE)

(72) Inventors: Jan Blömer, Essen (DE); Ilka Gehrke, Reutlingen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 245 days.

(21) Appl. No.: 17/972,026

(22) Filed: Oct. 24, 2022

(65) Prior Publication Data

US 2023/0130797 A1 Apr. 27, 2023

(30) Foreign Application Priority Data

Oct. 25, 2021 (DE) ..... 10 2021 127 688.8

(51) Int. Cl.

| | |
|---|---|
| ***D06F 35/00*** | (2006.01) |
| ***D06F 21/06*** | (2006.01) |
| ***D06F 23/02*** | (2006.01) |
| ***D06F 37/06*** | (2006.01) |
| ***D06F 39/20*** | (2024.01) |
| ***D06F 105/08*** | (2020.01) |

(52) U.S. Cl.

CPC ..... *D06F 35/005* (2013.01); *D06F 21/06* (2013.01); *D06F 23/02* (2013.01); *D06F 37/065* (2013.01); *D06F 39/20* (2024.01); *D06F 2105/08* (2020.02)

(58) Field of Classification Search

CPC ..... D06F 39/10; D06F 39/20

See application file for complete search history.

(56) References Cited

U.S. PATENT DOCUMENTS 3,977,219 A * 8/1976 Bochan ..... D06F 39/10 210/411
2018/0119327 A1 5/2018 Kim et al.
2019/0382943 A1* 12/2019 VanderZwaag ..... D06F 39/085

FOREIGN PATENT DOCUMENTS

DE 102019216339 A1 4/2021
WO 2018088321 A1 5/2018

* cited by examiner

*Primary Examiner* — Spencer E. Bell
(74) *Attorney, Agent, or Firm* — The Webb Law Firm

(57) ABSTRACT

Described and illustrated is a washing machine for washing textiles, including a tub for receiving a washing liquid, a laundry drum inserted at least partially into the tub, a drive for rotating the laundry drum in the tub and a discharge line connected to the tub for discharging washing liquid from the tub. In order to be able to separate the microplastic fibres more easily, cost-effectively and reliably from the washing water or another washing liquid, it is provided that an intermediate storage device is provided for temporarily storing washing liquid discharged via the discharge line, a centrifuge unit rotated by the drive together with the laundry drum for separating microplastic fibres and a return line for transferring the washing liquid from the intermediate storage device into the centrifuge unit.

14 Claims, 8 Drawing Sheets

WASHING MACHINE AND METHOD FOR WASHING TEXTILES

CROSS-REFERENCE TO RELATED APPLICATION

This application claims priority to German Patent Application No. 10 2021 127 688.8 filed Oct. 25, 2021, the disclosure of which is hereby incorporated by reference in its entirety.

BACKGROUND OF THE INVENTION

Field of the Invention

The invention relates to a washing machine for washing textiles, comprising a tub for receiving a washing liquid, a laundry drum inserted at least partially into the tub, a drive for rotating the laundry drum in the tub and a discharge line connected to the tub for discharging washing liquid from the tub. The invention further relates to a method for washing textiles using such a washing machine.

Description of Related Art

Washing machines are known in different configurations. Washing machines typically have a tub for receiving washing liquid, by means of which the textiles are washed. The textiles are thereby located in a laundry drum, which is provided in the tub and can be rotated therein. The textiles come into close contact with the washing liquid in the form of washing water through the corresponding rotation and are moved back and forth in the washing water. When the washing process is complete, the washing water is pumped out of the tub via a discharge line. Rotating the laundry drum further displaces liquid from the textiles. The laundry drum is then regularly set to very fast rotation, also known as spinning. The centrifugal forces thereby acting on the moisture remaining in the textiles displace the remaining moisture to a large extent from the textiles, so that the textiles dry more quickly after spinning.

The known washing machines are roughly divided into so-called top loaders and front loaders. In the case of top loaders, the laundry drum is filled with textiles from above. The laundry drum therefore has a textile opening on the upper side and a bottom on the lower sides. In this case, the laundry drum rotates about an at least substantially vertical axis of rotation. With front loaders, on the other hand, the laundry drum is filled with textiles laterally, i.e. at least substantially horizontally. The textile opening of the laundry drum therefore points to the side. The laundry drum has a base in the opposite horizontal direction and is rotated about an at least substantially horizontally aligned axis of rotation. Mixed forms are also known in which the laundry drum is rotated about a horizontal axis of rotation, but is loaded from above through a lockable hatch in the circumferential wall of the laundry drum.

It is also known that textiles often have plastic fibres, which are partially damaged when the textiles are worn or used, creating small pieces of the plastic fibres. If they are quite short, the fragments are also called microplastic fibres. The microplastic fibres usually get caught in the textiles once they have formed and are only released from the textiles when they are washed. The microplastic fibres are then pumped out of the washing machine with the washing water and released thereby into the environment. In some cases, the microplastic fibres are separated in wastewater treatment plants, provided that the washing water is actually supplied to a wastewater treatment plant. This is not necessarily the case in many countries around the world.

In order to reduce the environmental impact of corresponding microplastic fibres, it is therefore desirable to separate the microplastic fibres from the washing water immediately after they are released in the washing machine. Some proposals have already been made for the integration of separating devices into washing machines, but these have not produced satisfactory results. In particular, the solutions were too complex or not reliable enough to be widely used.

Therefore, the object underlying the present invention is to design and further develop the washing machine and the method in each case of the type mentioned at the outset and explained in more detail in such manner that the microplastic fibres can be separated more easily, cost-effectively and reliably from the washing water or another washing liquid.

SUMMARY OF THE INVENTION

This object is achieved in a washing machine according to the preamble of claim 1 in that an intermediate storage device is provided for temporarily storing washing liquid discharged via the discharge line, a centrifuge unit rotated by the drive together with the laundry drum for separating microplastic fibres and a return line for transferring the washing liquid from the intermediate storage device into the centrifuge unit.

The mentioned object is further achieved as described herein by a method for washing textiles using a washing machine as described herein,

- in which textiles are washed in the laundry drum in the washing liquid in the tub,
- in which the washing liquid is channelled from the tub via the discharge line into the intermediate storage device after washing,
- in which the washing liquid is channelled from the intermediate storage device via the return line into the centrifuge unit,
- in which the centrifuge unit is rotated together with the laundry drum,
- in which microplastic fibres are separated from the washing liquid in the centrifugal force direction during rotation in the centrifuge unit and
- in which the cleaned washing liquid is discharged.

The invention has recognised that the microplastic fibres washed out of the textiles can be easily and reliably separated from the washing liquid via a centrifuge unit. This is also possible in practice if the centrifuge unit is driven by the same drive together with the laundry drum. In any case, washing machines are already equipped with a drive to rotate the laundry drum when washing the textiles and to set it in very fast rotation in particular when spinning the textiles. The idea thereby underlying the separation of microplastic fibres is to perform the washing out and separation of the microplastic fibres step by step and generally to separate them from each other. This separation can take place since the washing liquid is collected and temporarily stored in an intermediate storage device between the actual washing and the separation. For this purpose, the washing liquid is channelled into the intermediate storage device via the discharge line after washing, from which intermediate storage device the washing liquid can be channelled into the centrifuge unit via a return line.

The tub in which the laundry drum is located at least in sections can therefore initially be emptied at least partially, in particular but at least substantially completely. This enables the laundry drum in the tub to be set into fast rotation, for example in order to spin and in this way at least partially dry the laundry, in particular in the form of textiles, still present in the laundry drum. However, it is not necessary for the laundry to remain in the laundry drum, while the microplastic fibres are separated from the washing liquid, although this will in many cases be preferred for pre-drying of the laundry. The laundry can also be removed from the laundry drum first before the microplastic fibres are separated. If the washing liquid were to remain predominantly in the tub, this would counter a rapid rotation of the laundry drum with an undesirably high resistance or would completely prevent a correspondingly fast rotation.

Thus, according to the method, the textiles are first placed in the laundry drum in a conventional manner and the laundry drum is then rotated in the tub containing washing liquid in order to cause the textiles to be washed. Subsequently, the washing liquid is at least partially channelled from the tub via the discharge line into the intermediate storage device, for which purpose a conventional pump can be used if required. For the sake of simplicity, the pump is preferably the same pump used for pumping out the washing liquid from the washing machine as a whole. However, this is not mandatory. It is also conceivable that the washing liquid flows from the tub in the direction of gravity into the intermediate storage device without using a corresponding pump. In this case, however, it will regularly be preferred if a pump is connected to the return line in such manner that the washing liquid can be conveyed from the intermediate storage device into the centrifuge unit. Alternatively, however, the rotation of the laundry drum can also be used to generate centrifugal forces which act on the washing liquid such that the washing liquid is conveyed from the intermediate storage device via the return line into the centrifuge unit. If the intermediate storage device is arranged above the centrifuge unit, the recirculation of the washing liquid from the intermediate storage device to the centrifuge unit can be driven by gravity, which would make the use of a pump unnecessary. If required, however, a separate pump can also optionally be used for recirculation.

Whether the washing liquid is conveyed out of the washing machine or into the intermediate storage device can for example be controlled by the position of a valve or shut-off device, for example a two-way valve. The washing liquid is then channelled via the return line into the centrifuge unit, which, together with the laundry drum, can be set to fast rotation, since the tub is now empty or at least empty enough. Otherwise, the resistances to be overcome for fast rotation of the laundry drum would be high and would require an unnecessarily large amount of energy. The centrifuge unit is rotated together with the laundry drum via the common drive so that the microplastic fibres settle radially outwards as a result of the centrifugal forces acting on the microplastic fibres and are thus separated from the washing liquid. The washing liquid cleaned or at least partially relieved of microplastic fibres is then discharged. The microplastic fibres preferably remain in the centrifuge unit and are removed separately.

In the manner described and using the described washing machine, only a few equipment-related additions to conventional washing machines are required and at the same time, a reliable separation of the microplastic fibres can take place directly in the washing machine at low costs. The washing machines can be laundry or industrial or rather commercial washing machines. However, they can also be washing machines for private use. In addition, the textiles can be laundry in the broadest sense, but in particular clothing. The invention can thereby be applied to both so-called top loaders and so-called front loaders.

Typical washing processes generally comprise a plurality of wash cycles, such as the actual washing and one or a plurality of rinse cycles. The intermediate storage device can therefore preferably be designed to receive only the washing water of one wash cycle or not all wash cycles. In this case, for example, the separation of microplastic fibres from the water occurring in a rinse cycle may be unnecessary.

In the present case, for the sake of simplicity, the washing liquid will preferably be washing liquid. Other washing liquids are therefore not excluded. The terms washing liquid and washing water are therefore to be understood broadly and overlapping with one another and partly synonymously.

For the sake of clarity and to avoid unnecessary repetition, the washing machine and the method are described together below, without distinguishing in detail between the washing machine and the method in each case. However, for the person skilled in the art, the context determines which features are particularly preferred for the washing machine and the method in each case.

In a first particularly preferred configuration of the washing machine, the centrifuge unit is coupled to the laundry drum in such manner that the centrifuge unit and the laundry drum are driven at least temporarily at the same rotational speed. In this way, a transmission is unnecessary, which reduces the complexity of the equipment. It also allows a centrifuge unit to be easily added to conventional washing machines. This is particularly the case if the centrifuge unit is provided in the laundry drum. The centrifuge unit can then be easily driven via the laundry drum. In order to save installation space at the same time and further reduce the complexity of the equipment, it is also advisable if the centrifuge unit is integrated into the laundry drum. The centrifuge unit can then be regarded as an integral element of the laundry drum if required, even if the centrifuge unit does not have to serve, or at least does not primarily have to serve, for washing or spinning the textiles.

Alternatively or additionally, good separation efficiency is achieved for the microplastic fibres in a manner that is simple in terms of equipment if the centrifuge unit has at least one annular centrifuge chute. This centrifuge chute can also be selectively supplied with washing liquid. A centrifuge chute can also be very easily integrated into a laundry drum if required. Irrespective of this, it is also expedient if the at least one centrifuge chute is provided adjacent to the textile opening of the laundry drum for filling the textiles and/or is provided adjacent to the bottom of the laundry drum arranged opposite the textile opening. The centrifuge chute can then be easily cleaned and separation can easily take place in parallel to the spinning of the textiles. The centrifuge chute does not thereby excessively impair the washing or spinning of the textiles. The annular centrifuge chute can be provided circumferentially and can thus form a virtually endless centrifuge chute. However, the centrifuge chute can also be divided into individual segments between which a change of washing liquid is not provided or provided only to a limited extent or is generally possible.

In addition, but in particular as an alternative, the centrifuge unit can also have at least one centrifuge chute extending at least substantially in a straight line. This allows the expedient channelling of the washing liquid through the washing machine as required and at the same time a separation of microplastic fibres if the bottom of the centrifuge chute points radially outwards. This can be achieved particularly expediently and reliably if the centrifuge chute extends at least substantially parallel to the axis of rotation of the laundry drum. In this case, further reduced complexity of equipment and easier integration of the centrifuge unit into the laundry drum can be achieved if the centrifuge chute extends on the inner side of the laundry drum.

For easy separation of the cleaned washing liquid and the microplastic fibres, it is advisable if the centrifuge chute has at least one weir-like overflow for cleaned overflow liquid, for example in the form of cleaned overflow water. The overflow liquid can then flow off continuously and sufficient washing liquid always remains in the centrifuge chute to separate further microplastic fibres therein. If the overflow is used with an at least substantially circumferential annular centrifuge chute, the overflow can also be provided at least substantially circumferentially. However, to increase the residence time of the washing liquid in the centrifuge chute, it may be advisable if the overflow is only provided in sections. A section or a plurality of sections may be considered for this purpose. In particular, a section can be considered which has a significant or even as large a distance as possible from at least one other section at which the washing liquid is supplied via the return line to the centrifuge chute.

The washing liquid must therefore first enter from the point of supply to the point of overflow, which can be accompanied by a sufficient residence time in order to be able to reliably separate the microplastic fibres during this time. In a simple configuration of the washing machine in terms of equipment, the overflow can be provided in such manner that the overflow liquid enters the tub. However, discharging the overflow liquid can also be simplified, if required, if the overflow liquid enters the discharge line connected to the tub for discharging washing liquid from the tub. For example, contact between the overflow liquid and the pre-dried textiles in the laundry drum can then also be avoided.

In order to be able to discharge the washing liquid remaining in the centrifuge chute and, if necessary, to avoid contact with the cleaned textiles, the centrifuge chute can be assigned a resealable residual liquid drain for draining the residual liquid remaining in the centrifuge chute after the separation of microplastic fibres. The residual liquid drain is then opened after the separation of the microplastic fibres in order to drain the remaining water. This can be achieved easily and reliably if the residual liquid drain is designed as a residual liquid flap. The residual liquid flap is easy to open and close. This applies in particular if the residual liquid flap is designed to force open as a result of gravity and close as a result of centrifugal force. If the laundry drum and/or the centrifuge chute is at a standstill or if the laundry drum and/or the centrifuge chute rotates only very slowly, gravity causes the residual liquid flap to open and the residual liquid can drain through the residual liquid flap. However, if the laundry drum and/or the centrifuge chute rotates very quickly during the actual separation of the microplastic fibres, the centrifugal force causes the residual liquid flap to close so that no uncleaned washing liquid can drain out via the residual liquid flap during this time. Alternatively, at least one spring means can also be used. The centrifugal force can then act against the restoring force of the at least one spring means or the centrifugal force can act obliquely or transversely to the centrifugal force, in particular if the centrifugal force and gravity act approximately in parallel, as is the case in particular with front loaders. The centrifugal force can then act against the restoring force of the spring means instead of against gravity.

In order to avoid mixing the overflow liquid and the residual liquid, e.g. to clean the residual liquid again, the overflow liquid and the residual liquid can be discharged separately from each other. For the sake of simplicity, the overflow can be connected to an overflow discharge line and the residual liquid drain to a residual liquid discharge line for separate discharging of overflow liquid and residual liquid.

For a high separation efficiency of microplastic fibres, it is desirable for the washing liquid to be cleaned to have a sufficient residence time in the at least one centrifuge chute. In order to achieve this, the at least one centrifuge chute can have an entry opening for the inflow of washing liquid in a radial direction further out than an upper edge of the overflow. The inflowing washing liquid cannot then flow out via the overflow immediately after entering the centrifuge chute without the microplastic fibres having had sufficient time to sink in the radial direction. The washing liquid must first flow inwards in a radial direction against the centrifugal force in order to reach the overflow, while the microplastic fibres migrate in the direction of the centrifugal force to the bottom of the centrifuge chute. It may thereby be particularly expedient to use two centrifuge chutes coupled to one another. The two centrifuge chutes can then be connected to one another via an opening forming the entry opening into the following centrifuge chute. The centrifuge chutes can then be arranged directly next to each other to save space. If the centrifuge chutes are not or cannot be arranged directly next to each other, the centrifuge chutes can also be connected via a channel which opens in the entry opening of the following centrifuge chute. In this way, the guidance of the washing liquid is improved and the residence time in the centrifuge chutes as a whole is further increased.

A space-saving configuration of the centrifuge unit can be achieved if the at least one centrifuge chute is arranged in at least one lifting bar of the laundry drum. Laundry drums are typically already equipped with lifting bars in the case of horizontally aligned laundry drums. These have the shape of ribs that protrude inwards into the laundry drum to circulate the textiles in the laundry drum and to lift water from the tub and allow it to drip onto the textiles. The at least one centrifuge chute can therefore be integrated into a lifting bar in a space-saving manner. For cleaning the centrifuge chute and for removing the separated microplastic fibres, it is advisable if the centrifuge chute and/or the lifting bar is/are designed to be removable.

The residence time of the washing liquid in the centrifuge unit can also be extended if required in that the at least one centrifuge chute comprises two chute elements extending at least substantially parallel to one another and to the axis of rotation and connected to one another via a deflection. The washing liquid can then first run in a direction along the first chute element and after passing the deflection through the second chute element in the opposite direction. If required, further deflections and chute elements can be added to further increase the residence time. In this case, the chute elements can be arranged one behind the other in a radial direction and/or next to one another in a circumferential direction. In this case, it is generally advisable if the inlet opening provided for the washing liquid and the corresponding outlet opening in each case of the entire centrifuge chute is assigned to the bottom of the laundry drum or to the textile opening of the laundry drum. The supply and discharge of washing liquid can then simply take place on the same side of the laundry drum.

Alternatively or additionally, the at least one centrifuge chute can also be provided in a centrifuge cartridge at the bottom of the laundry drum. This means that the centrifuge unit can be reliably decoupled from the textiles in the laundry drum, if required. In addition, the centrifuge cartridge can be designed so as to be easily removable for easy and reliable cleaning. If required, it is advisable for the centrifuge cartridge to be decoupled from the textiles in the laundry drum if at least one inlet opening and at least one outlet opening for the washing liquid are provided on the rear side of the centrifuge cartridge. The rear side of the centrifuge cartridge preferably points in the direction of the bottom of the laundry drum.

In a first particularly preferred configuration of the method, the separation of the microplastic fibres from the washing liquid takes place by rotating the laundry drum when spinning the textiles in the laundry drum. In this case, spinning for pre-drying the textiles, which takes place anyway, can also be used in a time- and energy-saving manner to separate the microplastic fibres. Alternatively or additionally, the separated microplastic fibres can remain in the washing machine after washing the textiles. The microplastic fibres can then simply be removed manually, for example by cleaning the at least one centrifuge chute.

If the cleaned water flows out of the centrifuge unit via a weir-like overflow as overflow liquid or overflow water, the separation of washing liquid and microplastic fibres can be carried out very easily and reliably in terms of the equipment and method. Alternatively or additionally, residual liquid not flowing out via the overflow after the separation of the microplastic fibres can also drain as residual liquid from the centrifuge unit via a residual liquid drain, in particular a residual liquid flap. Contact between the residual liquid and the textiles remaining in the laundry drum can then be avoided.

BRIEF DESCRIPTION OF THE DRAWINGS

The invention will be explained in more detail below on the basis of a drawing which merely represents preferred exemplary embodiments. The drawing shows.

DESCRIPTION OF THE INVENTION

Figure 1A:
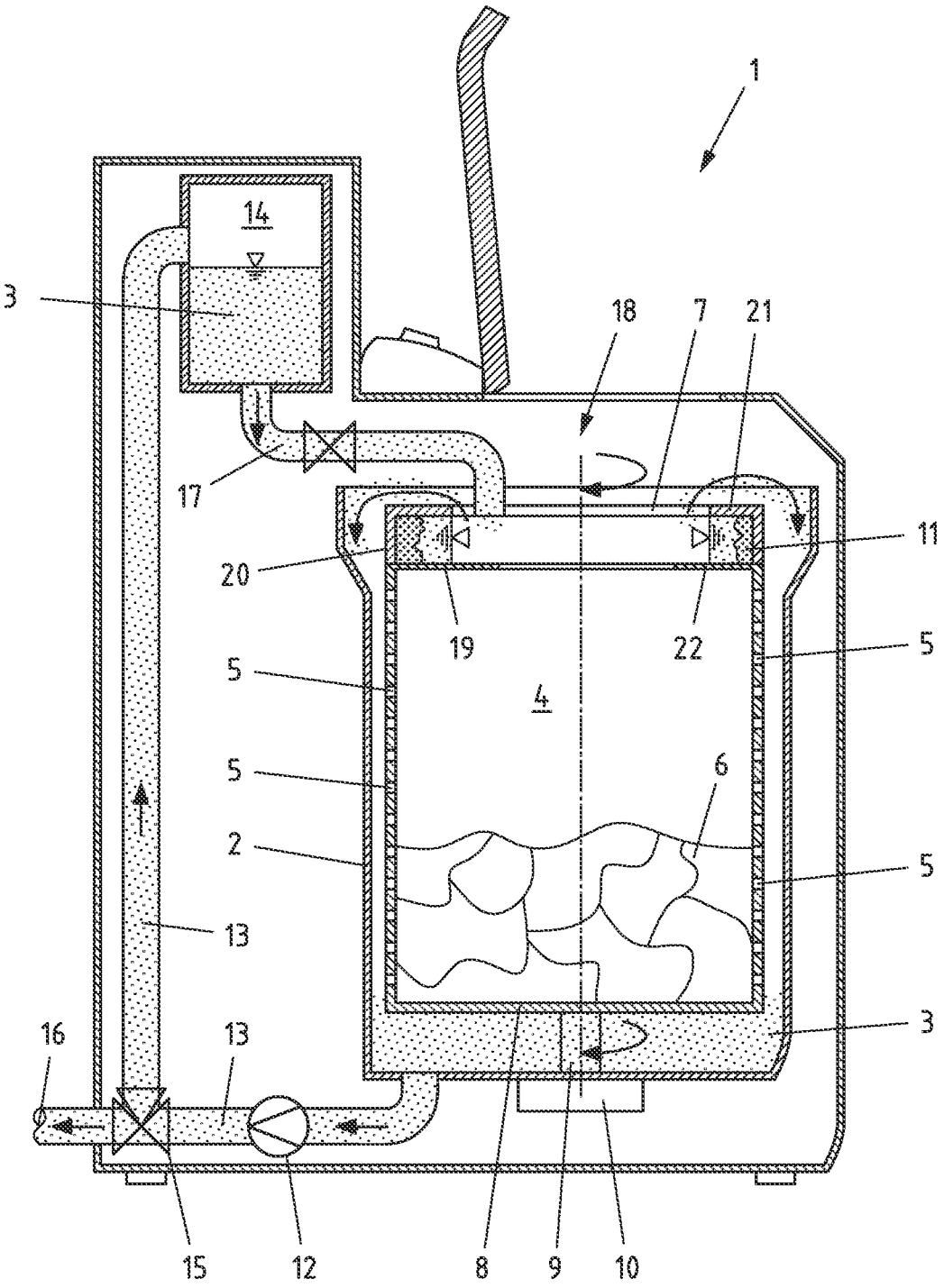
FIG. 1A-B a first washing machine according to the invention and a detail of the washing machine in a schematic sectional view from the side, FIG. 2 a detail of a second washing machine according to the invention in a schematic sectional view from the side, FIG. 3 a detail of a third washing machine according to the invention in a schematic sectional view from the side, FIG. 4 a fourth washing machine according to the invention in a schematic sectional view from the side, FIG. 5 a detail of a fifth washing machine according to the invention in a schematic sectional view from the side, FIG. 6A-B a sixth washing machine according to the invention and a detail of the washing machine in schematic sectional views from different sides and FIG. 7 a detail of a seventh washing machine according to the invention in a schematic sectional view from the side.

In FIG. 1A, a sectional view of a washing machine 1 in the configuration of a top loader is represented. The washing machine 1 thereby has a tub 2 in which washing liquid 3 in the form of washing water can be introduced. In principle, a different washing liquid could also be used, but since the washing machine will be preferred in particular for use with washing water, the term washing water is used below, but other liquids should not thereby be excluded.

In the tub 2, there is a laundry drum 4, which has openings 5 via which washing water 3 can flow into the laundry drum 4 receiving the textiles 6 to be washed. The textiles 6 are introduced into the laundry drum 4 from above through a textile opening 7 and are supported by the opposite bottom 8 of the laundry drum 4. The laundry drum 4 is connected via a shaft 9 to a drive 10, which is an electromotive drive 10. The electromotive drive 10 sets the laundry drum 4 into rotation, whereby the direction of rotation can change over time in order to ensure a satisfactory washing process of the textiles 6. When the washing process of the textiles 6 is completed, the microplastic fibres 11 have largely transferred from the textiles 6 to the washing water 3. The washing water 3 enriched with the microplastic fibres 11 is now pumped out of the tub 2 of the washing machine 1 via a pump 12 and pumped into an intermediate storage device 14 via a discharge line 13. For this purpose, a shut-off device 15 ensures that the washing water 3 is not pumped out of the washing machine 1 via an outlet opening 16. During the suction of washing water 3 from the tub 2, the laundry drum 4 can be set into a slight rotation such that additional washing water 3 is removed from the textile 6. If the washing water 3 is received at least for the most part in the intermediate storage device 14, the laundry drums 4 can be spun or rotated at a very high rotational speed. This would be referred to as spinning if the textiles 6 are still present in the laundry drum 4. This will in many cases be preferred in order to further drain the textiles 6.

If the laundry drum 4 rotates very quickly, the washing water 3 can be channelled from the intermediate storage device 14 via a return line 17 into a centrifuge unit 18, which in the represented and in this respect preferred washing machine 1 comprises a centrifuge chute 19 provided in the edge of the laundry drum 4 adjoining the textile opening 7. It is not represented in detail that the centrifuge unit 18 and/or the centrifuge chute 19 is designed to be removable in order to be able to clean it better. The centrifuge chute 19 is provided circumferentially around the laundry drum 4 and has a bottom 20 on which the microplastic fibres 11 settle as a result of the centrifugal forces. The cross-section of the centrifuge chute 19 is at least substantially U-shaped, wherein the two U-limbs are of different lengths. The U-limb 21 facing the textile opening 7 of the laundry drum 4 is shorter than the opposite U-limb 22 such that the free end of the outer, shorter U-limb 21 has an overflow 23 for the washing water 3. For the sake of simplicity, the overflow 23 can be provided circumferentially to the centrifuge chute 19. However, in order to increase the residence time of the washing water 3 in the centrifuge chute 19, it may be advisable if the overflow 23 is only provided in sections. One or a plurality of sections can be provided with overflow 23. The washing water 3 is then supplied at least temporarily at a greater distance from the overflow 23 of the centrifuge chute 19, so that the washing water 3 must cover a greater distance from there in order to reach the next overflow 23. This ensures an overall sufficient residence time of the washing water 3 in the centrifuge chute 19.

From the at least one overflow 23, the washing water 3 then passes back into the tub 2 as overflow liquid 24 in the form of overflow water, from where the overflow water 24 can be pumped out of the washing machine 1 from the outlet opening 16. For this purpose, the corresponding shut-off device 15 is then set such that the pump 12 pumps the overflow water 24 not into the intermediate storage device 14, but out of the washing machine 1. Since the rotational speeds during spinning of the textiles 6 are typically already very high, a very large part of the microplastic fibres 11 washed out of the textiles 6 can simultaneously be separated during spinning. The separated microplastic fibres 11 can then be manually removed from the centrifuge chute 19 and disposed of in a suitable manner.

Figure 1B:
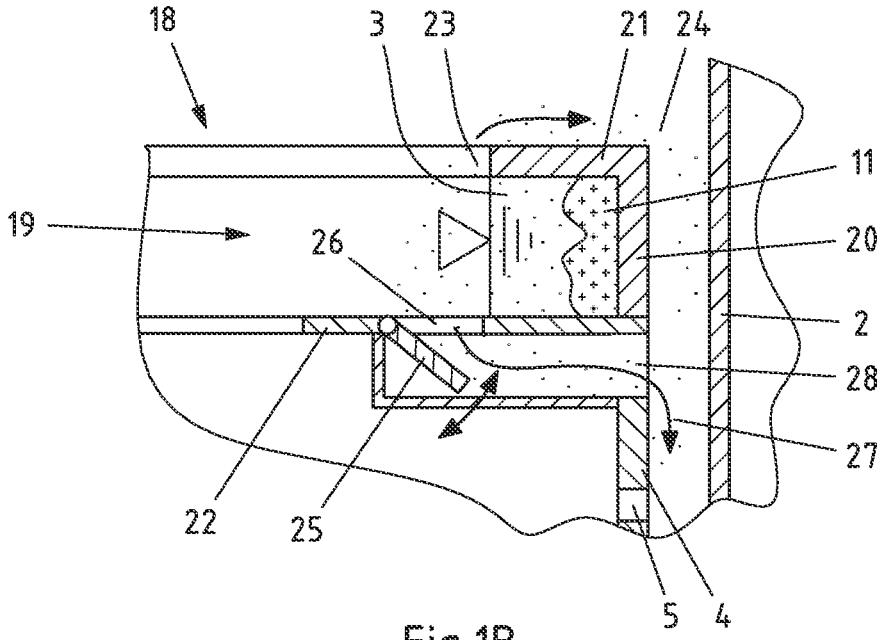

In FIG. 1B, a detail of the washing machine 1 from FIG. 1A in the region of the centrifuge chute 19 is represented in an enlarged manner. The centrifuge chute 19 circulates around the textile opening 7 of the laundry drum 4 and has a higher circumferential U-limb 22 in the direction of the bottom 8 of the laundry drum 4 than the U-limb 21 towards the textile opening. As a result of the centrifugal forces during the fast rotation of the laundry drum 4, the microplastic fibres 11 settle on the bottom 20 of the centrifuge chute 19 and the cleaned washing water 3 overflows outwards as overflow water 24 via the overflow 23 as the upper outer edge of the centrifuge chute 19. On the rear side of the centrifuge chute 19, the overflow water 24 runs downwards on the outer side of the laundry drum 4 in the direction of the bottom of the tub 2. While the laundry drum 4 rotates quickly, a residual liquid flap 25 designed as a residual water flap is also closed. This is articulated so as to be pivotable on the centrifuge chute 19 such that the free end of the residual water flap 25 points approximately radially outwards with sufficient centrifugal forces and thus closes the centrifuge chute 19.

If the rotational speed of the laundry drum 4 decreases, the influence of the centrifugal force on the residual water flap 25 prevails, which consequently hangs downwards and releases a residual water opening 26 in the lower edge of the centrifuge chute 19. Residual liquid 27 in the form of residual water can then be drained through this residual water opening 26 from the centrifuge chute 19, which has passed as overflow water 24 via the overflow 23 of the centrifuge chute 19. The residual water 27 enters a residual water channel 28 in order to avoid contact with the textiles 6 in the laundry drum 4. In the represented and in this respect preferred washing machine 1, the residual water channel 28 opens at the outer side of the laundry drum 4, so that the overflow water 24 and the residual water 27 can be collected together in the tub 2, provided that the overflow water 24 has not already been pumped out before the residual water 27 returns to the tub 2.

With regard to the representation of FIG. 1B, it should be noted that this is purely schematic and that the washing water 3 in the centrifuge chute 19 is represented for the case where the laundry drum 4 rotates very quickly. For the sake of clarity, the residual water flap 25, on the other hand, is represented in an open state, which occurs if the laundry drum 4 does not rotate or rotates only slowly. In addition, it should be noted in principle that one can essentially proceed such that the textiles 6 are first spun until no or hardly any washing water 3 can be removed from the textiles 6. The washing water 3 from the intermediate storage device 14 can then be cleaned by means of the centrifuge unit 18 for the purpose of separating microplastic fibres 11. However, washing water 3 can also be cleaned in the centrifuge unit 18 for the purpose of separating microplastic fibres 11, while washing water 3 is removed from the textiles 6 by spinning the textiles 6. The washing water 3 can then be pumped together at least partially and/or temporarily back into the intermediate storage device 14 and then supplied back to the centrifuge unit 18. Almost all washing water 3, including the washing water 3 remaining in the textiles 6 during the washing process, is treated in the centrifuge unit 18.

Figure 2:
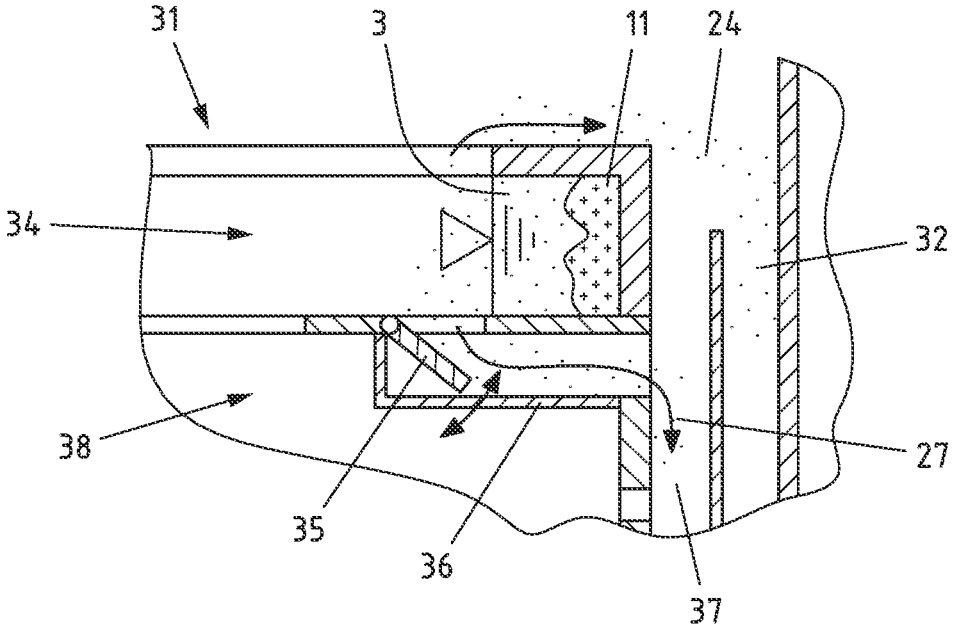

In FIG. 2, a detail of an alternative washing machine 31 in the manner of a top loader according to FIG. 1B is represented. The washing machine 31 is at least substantially the same as the washing machine 1 of FIG. 1. However, an outer overflow discharge line 32 is provided into which the overflow water 24 enters as a result of the centrifugal forces acting on the overflow water 24. The overflow water 24 is then discharged via the overflow discharge line 32, and namely separately from the residual water 27. The residual water 27 enters from the centrifuge chute 34 via the residual water flap 35 and the residual water channel 36 into a separate residual water discharge line 37. In this way, if desired, the overflow water 24 with relatively few microplastic fibres 11 can be separated from the residual water 27, which can potentially have a significant proportion of microplastic fibres 11. The residual water 27 is discharged in order to avoid coming into contact with the textiles 6 in the laundry drum 38 and remaining in the washing machine 31. The residual water 27 can then be cleaned during the next washing process together with the further washing water 3.

Figure 3:
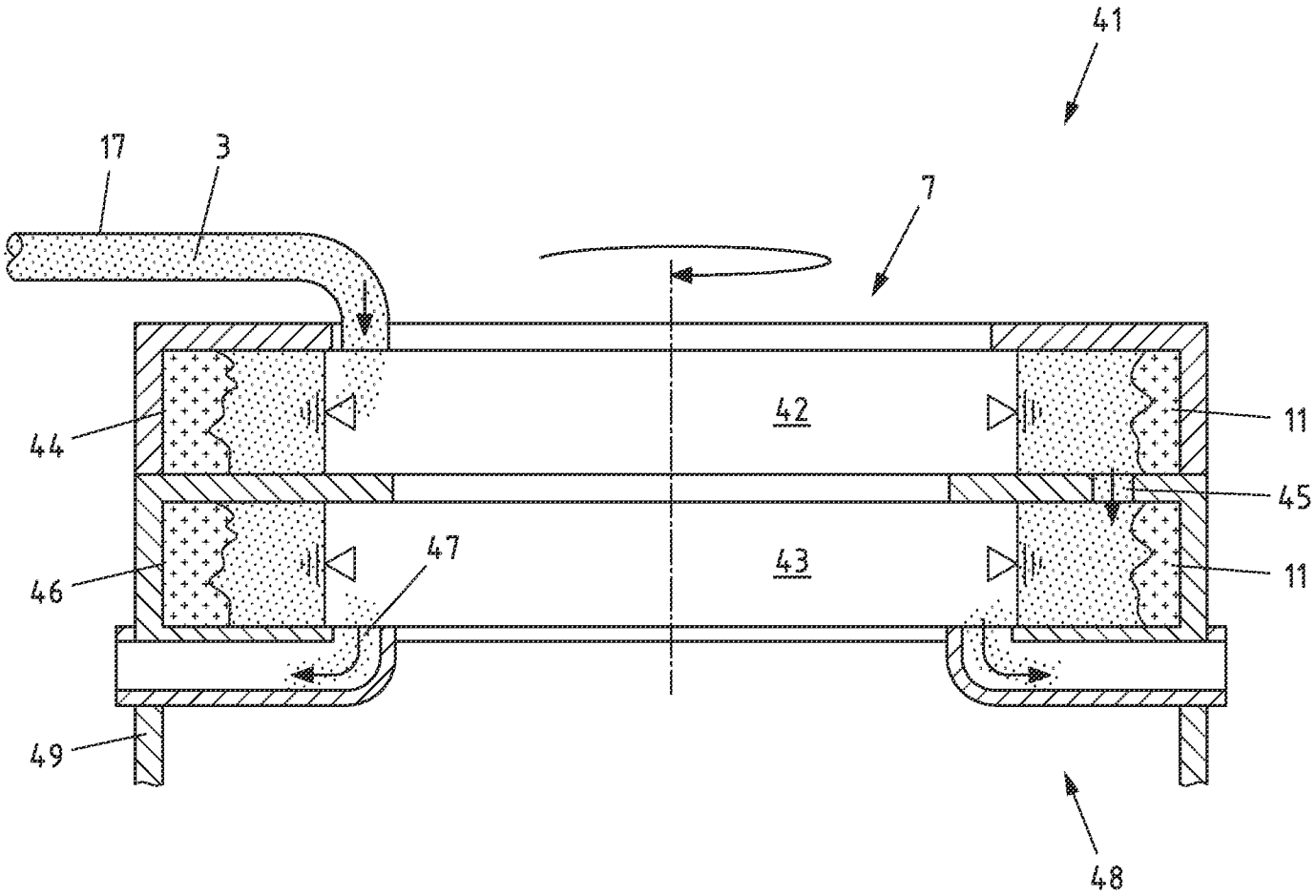

In FIG. 3, a detail of a further washing machine 41 in the manner of a top loader according to FIG. 1B is represented. The washing machine 41 is thereby at least substantially the same as the washing machine 1 of FIG. 1. In contrast, however, two centrifuge chutes 42, 43 are provided on top of one another and adjacent to one another. In this washing machine 41, the washing water 3 enters via the return line 42 into the upper centrifuge chute 42, which has an opening in the region of the bottom 44 corresponding to at least one entry opening 45, via which the washing water 3 passes from the first upper centrifuge chute 42 into the second, lower centrifuge chute 43, namely in the region of the bottom 46 of the lower centrifuge chute 43. If required, only one or a plurality of entry openings can be distributed more or, if required, less evenly over the circumference of the upper centrifuge chute 42.

An overflow 47 for the overflow of overflow water 24 is provided at the lower edge of the lower centrifuge chute 43. Therefore after entering the centrifuge unit 48 of the laundry drum 49, the washing water 3 only exits the centrifuge unit 48 again after a considerable residence time, which has a positive effect on the separation of the microplastic fibres 11. In principle, however, the two centrifuge chutes could also be interchanged so that the washing water 3 first enters the first, lower centrifuge chute and then passes into the second, upper centrifuge chute on the bottom side in order to overflow outwards as overflow water 24 via the upper edge of the upper centrifuge chute.

The overflow 24 is designed as a weir which limits the fill level in the centrifuge chute 19 from which the overflow water 24 flows via channels to the outer sides of the laundry drum 49 and back into the tub there.

Figure 4:
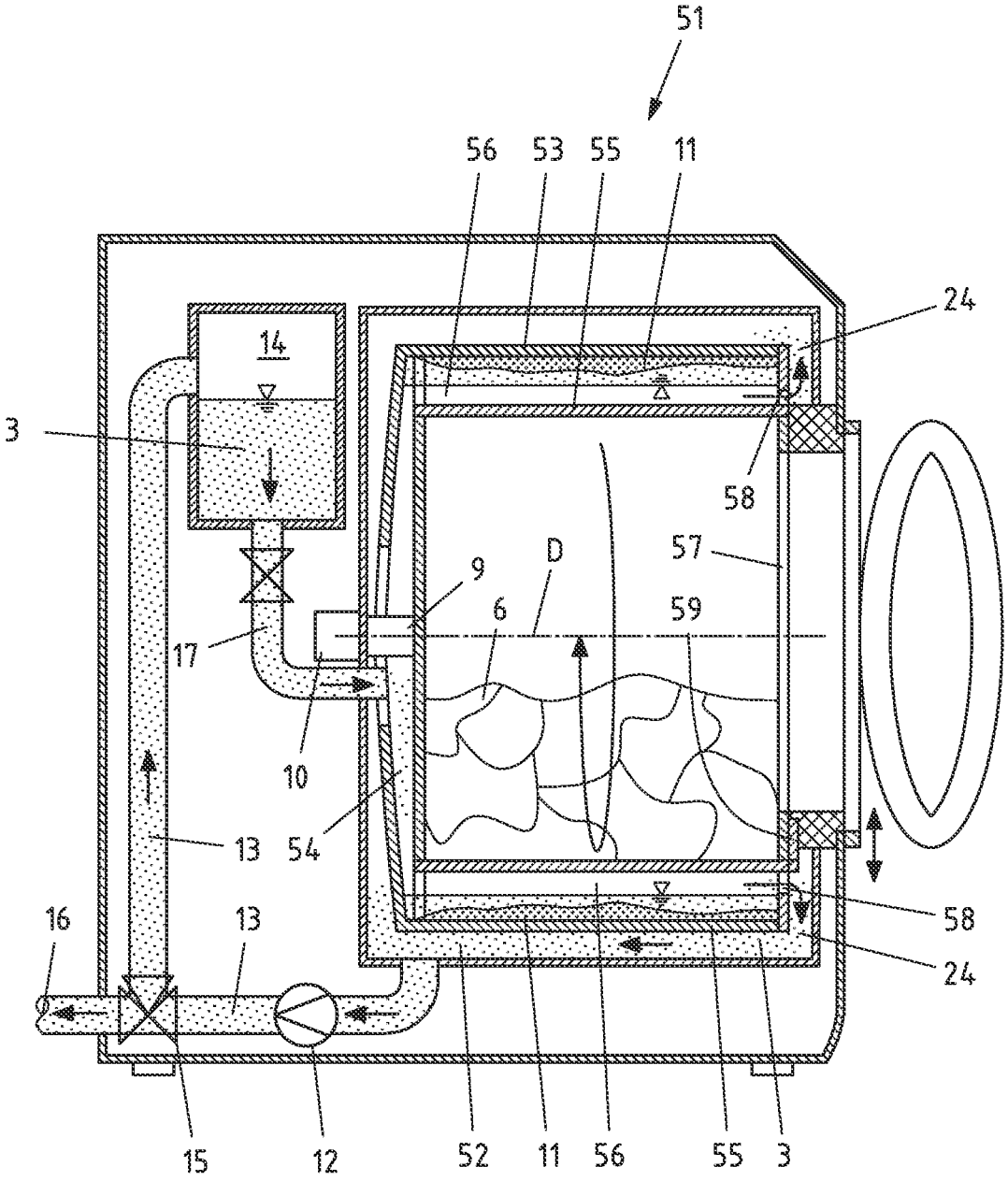

In FIG. 4, a washing machine 51 in the manner of a front loader is represented in a sectional view. In this washing machine 51, too, a tub 52 and a laundry drum 53 arranged therein are provided. However, the laundry drum 53 and the tub 52 are inclined to the side by about 90° compared to a top loader. Thus, the axis of rotation D of the laundry drum 53 does not extend roughly vertically upwards, but roughly horizontally to the side. In the case of the washing machine 51 of FIG. 4, analogously to washing machine 1 of FIG. 1, an intermediate storage device 14 for washing water 3 is provided which is connected to the tub 52 via a drain line 13 and a return line 17. A pump 12 and a shut-off device 15 in the form of a two-way valve are provided for circulating or pumping the washing water 3 out of the outlet opening 16 in order to specify the direction of the washing water flow.

The return line 17 guides the washing water 3 from the intermediate storage device 14 into a circumferential return channel 54 behind the bottom 46 of the laundry drum 53 and, if required, at a height above the height of the washing water 3 in the tub 52 when washing the textiles 6. From the return channel 17, the washing water 3 enters at least one centrifuge chute 55, which extends within a lifting bar 56 in a roughly straight line and roughly parallel to the axis of rotation D of the laundry drum 53. The centrifuge chute 55 is therefore provided in a region of the laundry drum 53 which is not accessible to the textiles 6. The washing water 3 thereby flows to the front end of the laundry drum 53 in the region of the textile opening 57 and flows out there via an overflow 58 of the centrifuge chute 55 as cleaned overflow water 24 into the tub 52. After the microplastic fibres 11 have been separated from the washing water 3 in the at least one centrifuge chute 55, the centrifuge chute 55 can be removed from the laundry drum 53 in order to clean the centrifuge chute 53 and dispose of the microplastic fibres 11 separated there. Alternatively or additionally, the respectively corresponding lifting bar 56 can also be removed or opened in order to gain access to the associated centrifuge chute 55. The centrifuge chute 55 can then be cleaned and the removed microplastic fibres 11 can then be disposed of. The part of the lifting bar 56 of the represented and in this respect preferred washing machine 51 comprising the centrifuge chute 55 must be closed with respect to the interior of the laundry drum 53. However, other regions of the lifting bar 56 can nonetheless, as is known, be hollow and have openings towards the laundry drum 53.

The overflow 58 of the centrifuge chute 55 can be closed during the washing of the textiles 6 by a non-return flap 59 in order to prevent the washing water 3 from penetrating into the centrifuge chute 55 during the washing of the textiles 6 and microplastic fibres 11 that have already been separated from being flushed out into the washing water 3. In the represented and in this respect preferred washing machine 51, the non-return flap 59 can for example be adjusted by means of an electromagnet. If the non-return flap 59 is assigned to the outer side of the laundry drum 52, the non-return flap 59 can simply be opened by means of the centrifugal force or the water pressure during spinning, in particular against the restoring force of a spring means.

Figure 5:
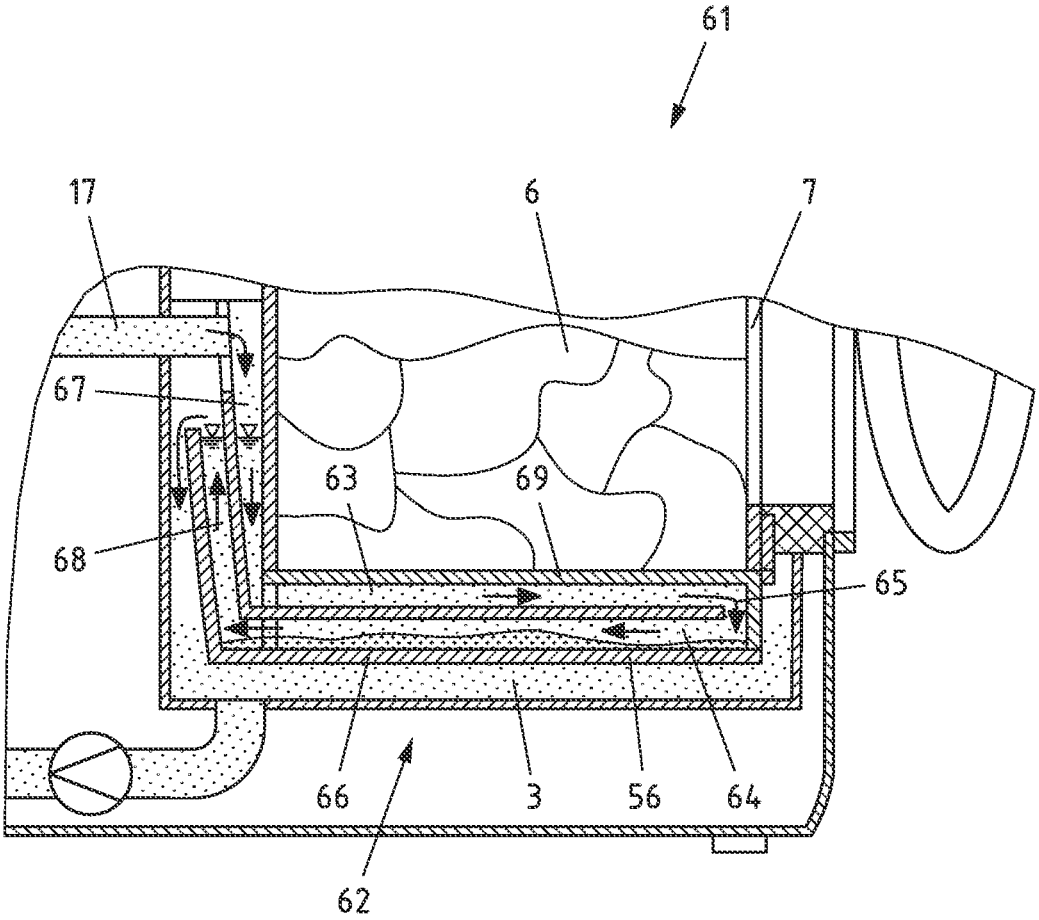

In FIG. 5, an alternative washing machine 61 to the washing machine 51 according to FIG. 4 is represented. In contrast, the centrifuge chute 62 has two chute elements 63, 64, which are connected to one another by at least one deflection 65. Thus, the washing water 3 initially flows in one direction along the first chute element 63 and then after a redirection of the flow in a deflection 65 in the opposite direction along the second chute element 64. In the case of the represented washing machine 61, the washing water 3 is supplied on the same side of the laundry drum 66, in this case the side close to the bottom, via a return channel 67 and discharged via a separate discharge channel 68. The flow of the washing water 3 is maintained by centrifugal forces. In the represented washing machine 61, the chute elements 63, 64 are provided one above the other in a radial direction. Alternatively or additionally, however, it can also be provided that the chute elements are arranged next to one another in the circumferential direction and are connected to one another by a deflection pointing in the circumferential direction. Furthermore, the chute elements 63, 64 and the deflection 65 are integrated into a lifting bar 69. This integration into a lifting bar 69 can also be provided if the chute elements 63, 64 are provided next to one another. However, it would also be conceivable to integrate the chute elements 63, 64 and the deflection 65 into the drum outside of lifting bars 69.

Figure 6A:
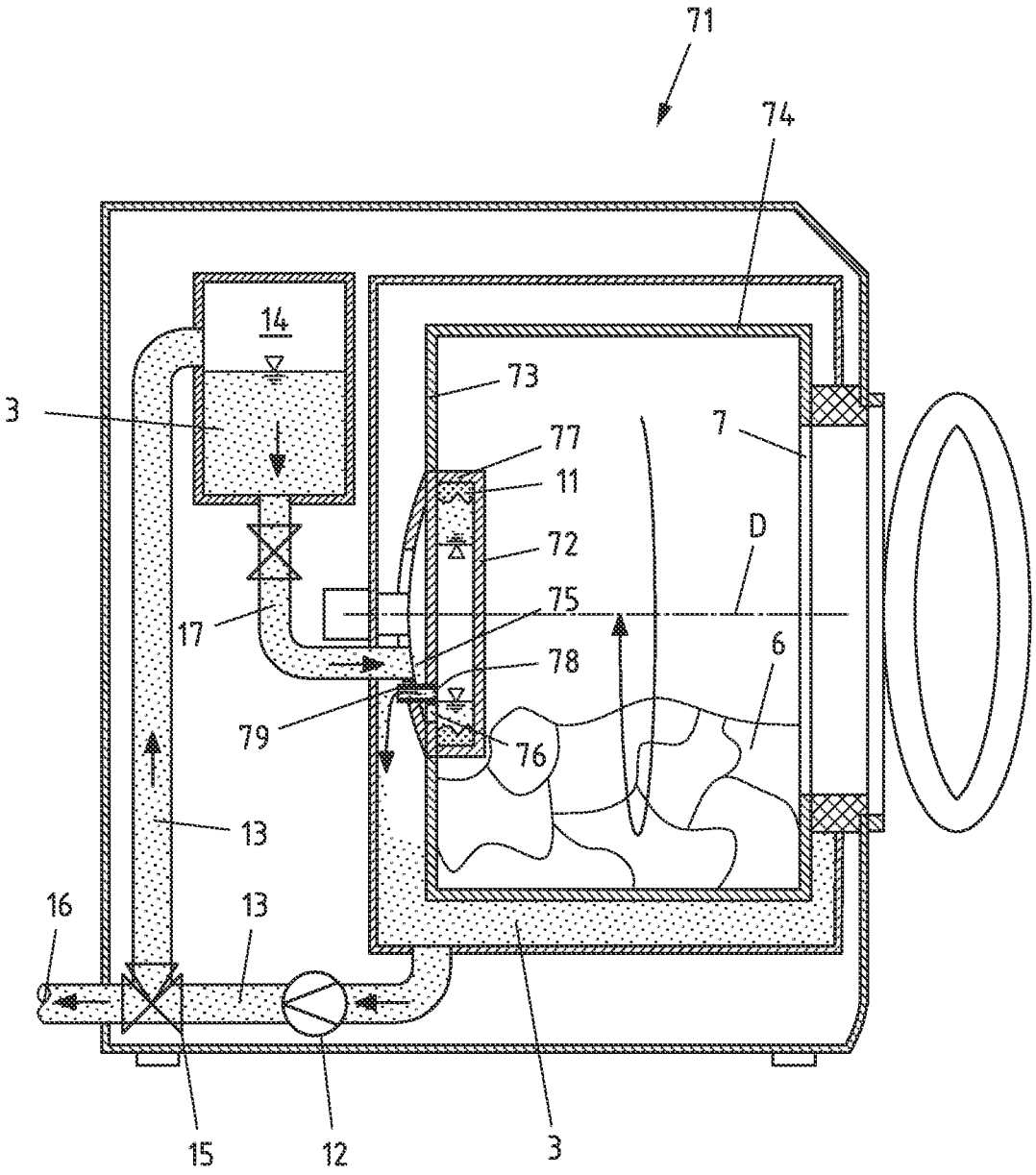
Figure 6B:
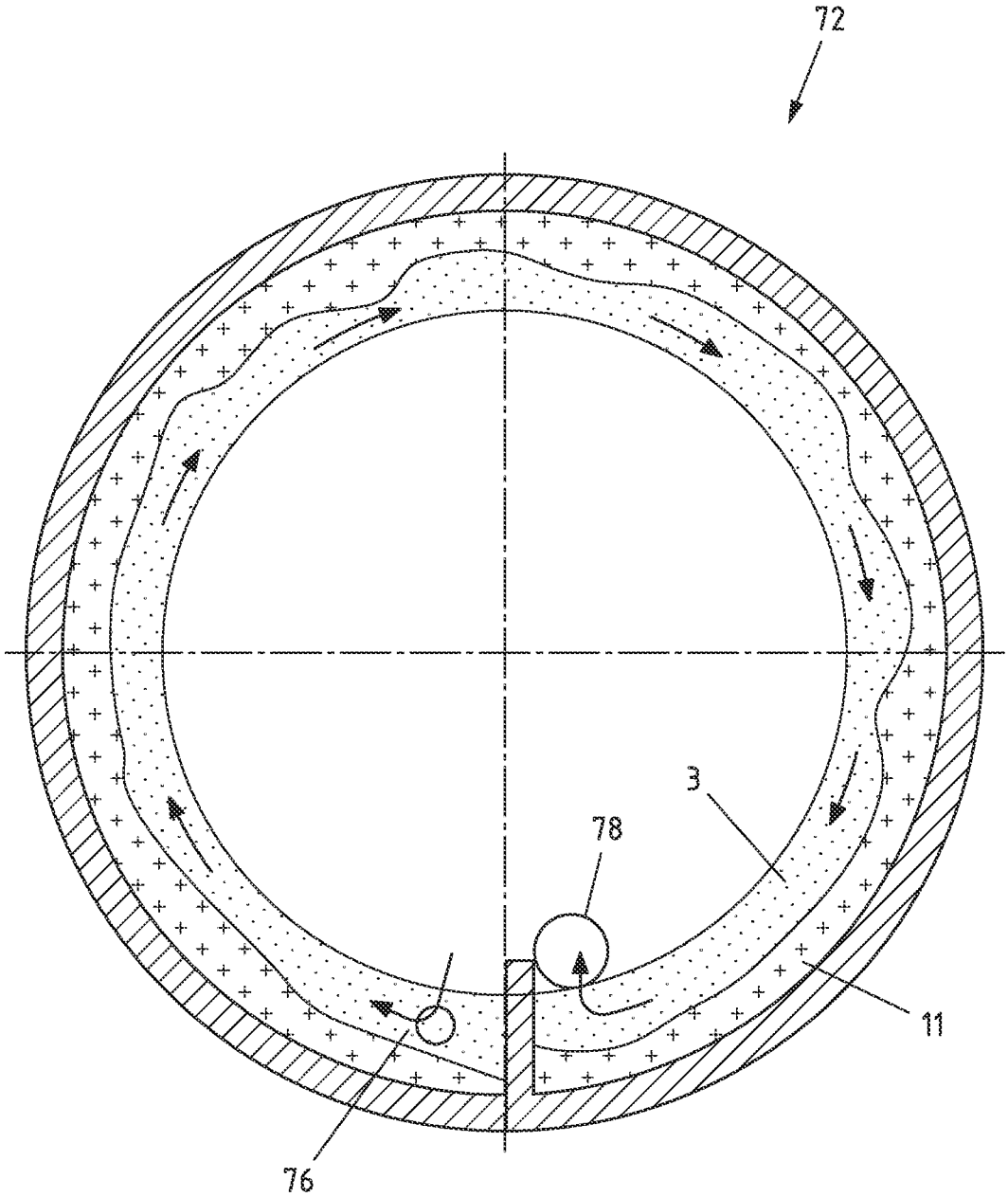

In FIG. 6A, an alternative washing machine 71 to the washing machine 51 according to FIG. 4 is represented. The washing machine 71 according to FIG. 6A has a centrifuge cartridge 72, which is assigned to the inner side of the bottom 73 of the laundry drum 74 and can be disassembled for cleaning and removing the separated microplastic fibres 11. A return channel 75 is thereby assigned to the bottom 73 of the laundry drum 74 in which the washing water 3 can be returned via the return line 17 from the intermediate storage device 14. From the circumferentially provided return channel 75, the washing water 3 enters the centrifuge cartridge 72 via an inlet opening 76, which cartridge 72 is represented viewed from behind in FIG. 6B. The inlet opening 76 is thereby provided further out in the radial direction than the maximum water level in the centrifuge chute 77 of the centrifuge cartridge 72. However, this is not mandatory. The centrifuge chute 77 is thereby not completely circumferential, but rather provided with opposing ends in the circumferential direction, wherein the inlet opening 76 is assigned to one end and the outlet opening 78 to the other end. In this case, the outlet opening 78 is provided slightly further inwards in the radial direction than the inlet opening 76 to determine the maximum water level. The washing water 3 must therefore flow virtually in a circle once in order pass from the inlet opening 76 to the outlet opening 78, which is connected to a discharge channel 79. The associated residence time should be sufficient to achieve a satisfactory separation of the microplastic fibres 11. Alternatively, two or more centrifuge chutes can also be provided one after the other in the circumferential direction in the centrifuge cartridge. An inlet opening can then be assigned to one end of a centrifuge chute and an outlet opening to the respective other end of the centrifuge chute.

Figure 7:
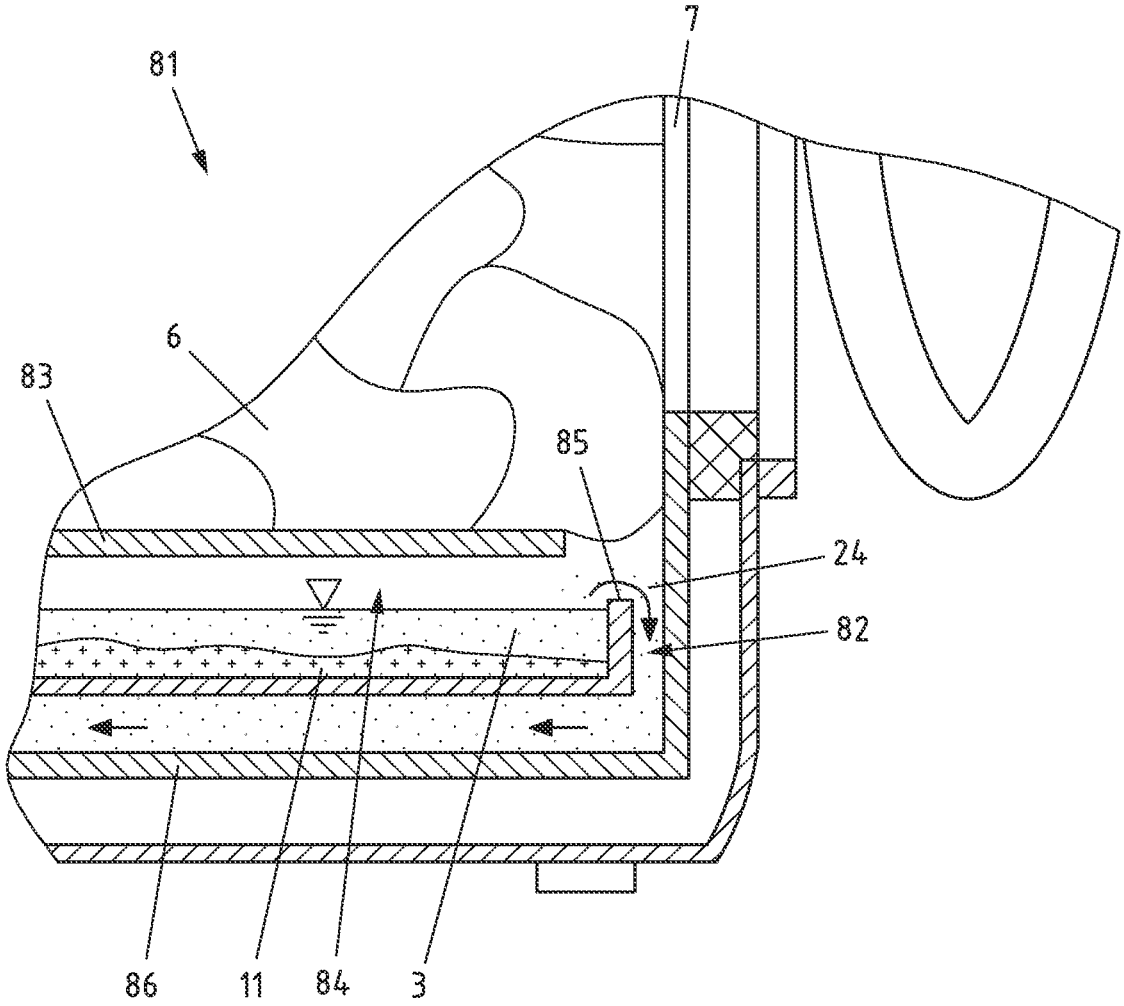

In FIG. 7, a further alternative of a washing machine 81 based on the washing machine 1 according to FIG. 1A-B is represented in detail. Again, adjoining the textile opening 7, a centrifuge unit 82 is integrated into the laundry drum 83, which has a circumferential centrifuge chute 84. At least one overflow 85 of the centrifuge chute 84 generally provided with a U-shaped cross-section is provided at least in sections facing the textile opening 7. If required, the washing water 3 can be pulled from the intermediate storage device into the centrifuge chute 77 as a result of the centrifugal forces when rotating the laundry drum 83. The washing water 3, which flows out laterally from the centrifuge chute 84 as overflow water 24 via the overflow 85, enters the tub 86 and can be pumped out from there. Alternatively, the overflow water 24 could also enter an overflow discharge line and be discharged via the overflow discharge line.

LIST OF REFERENCE NUMERALS

1 Washing machine
2 Tub
3 Washing water
4 Laundry drum
5 Openings
6 Textiles
7 Textile opening
8 Bottom
9 Shaft
10 Drive
11 Microplastic fibres
12 Pump
13 Discharge line
14 Intermediate storage device
15 Shut-off device
16 Outlet opening
17 Return line
18 Centrifuge unit
19 Centrifuge chute
20 Bottom

21 U-limb
22 U-limb
23 Overflow
24 Overflow water
25 Residual water flap
26 Residual water opening
27 Residual water
28 Residual water channel
31 Washing machine
32 Overflow discharge line
34 Centrifuge chute
35 Residual water flap
36 Residual water channel
37 Residual water discharge line
38 Laundry drum
41 Washing machine
42 Upper centrifuge chute
43 Lower centrifuge chute
44 Bottom
45 Entry opening
46 Bottom
47 Overflow
48 Centrifuge unit
49 Laundry drum
51 Washing machine
52 Tub
53 Laundry drum
54 Return channel
55 Centrifuge chute
56 Lifting bar
57 Textile opening
58 Overflow
59 Non-return flap
61 Washing machine
62 Centrifuge chute
63 Chute element
64 Chute element
65 Deflection
66 Laundry drum
67 Return channel
68 Discharge channel
69 Lifting bar
71 Washing machine
72 Centrifuge cartridge
73 Bottom
74 Laundry drum
75 Return channel
76 Inlet opening
77 Centrifuge chute
78 Outlet opening
79 Discharge channel
81 Washing machine
82 Centrifuge unit
83 Laundry drum
84 Centrifuge chute
85 Overflow
86 Tub
D Axis of rotation

The invention claimed is:

1. A washing machine for washing textiles, comprising a tub for receiving a washing liquid, a laundry drum at least partially in the tub, a drive for rotating the laundry drum in the tub and a discharge line connected to the tub for discharging washing liquid from the tub, wherein an intermediate storage container is provided for temporarily storing washing liquid discharged via the discharge line, a centrifuge container is rotated by the drive together with the laundry drum for separating microplastic fibres and a return line is provided for transferring the washing liquid from the intermediate storage container into the centrifuge container; and a residual liquid drain removes a residual liquid from the centrifuge container into a space between the tub and the drum, wherein the residual liquid has been separated from the microplastic fibres in the centrifuge container.

2. The washing machine according to claim 1, wherein the centrifuge container is coupled to the laundry drum in such manner that the centrifuge container and the laundry drum are driven at least temporarily at the same rotational speed and in that, preferably, the centrifuge container is provided in the laundry drum, in particular is integrated into the drum.

3. The washing machine according to claim 1, wherein the centrifuge container has at least one annular centrifuge chute and in that, preferably, the at least one centrifuge chute is provided adjacent to a textile opening of the laundry drum and/or adjacent to the bottom of the laundry drum opposite the textile opening.

4. The washing machine according to claim 1, wherein the centrifuge container has at least one centrifuge chute extending at least substantially in a straight line and in that, preferably, the centrifuge chute extends at least substantially parallel to the axis of rotation of the laundry drum, in particular on the inner side of the laundry drum.

5. The washing machine according to claim 3, wherein the centrifuge chute has at least one weir-like overflow for cleaned overflow liquid and in that, preferably, the overflow is provided in such manner that the overflow liquid enters the tub and/or the discharge line connected to the tub for discharging washing liquid from the tub.

6. The washing machine according to claim 3, wherein the residual liquid drain is resealable and in that, preferably, the residual liquid drain is designed as a residual liquid flap and in that, further preferably, the residual liquid flap is designed to be opened as a result of gravity and closed as a result of centrifugal force.

7. The washing machine according to claim 6, wherein an overflow is connected to an overflow discharge line and the residual liquid drain is connected to a residual liquid discharge line for separately discharging overflow liquid and residual liquid.

8. The washing machine according to claim 3, wherein the at least one centrifuge chute has an entry opening for an inflow of washing liquid in a radial direction further outwards than an upper edge of an overflow and in that two centrifuge chutes are connected to one another via an opening or a channel forming the entry opening.

9. The washing machine according to claim 4, wherein the at least one centrifuge chute is arranged in at least one lifting bar of the laundry drum and in that, preferably, the centrifuge chute and/or the lifting bar is designed to be removable.

10. The washing machine according to claim 4, wherein the at least one centrifuge chute comprises two chute elements extending at least substantially parallel to one another and to the axis of rotation and connected to one another via a deflection and in that, preferably, an inlet opening and an outlet opening of the centrifuge chute for the washing liquid is assigned to the bottom of the laundry drum or to a textile opening of the laundry drum.

11. The washing machine according to claim 3, wherein the at least one centrifuge chute is provided in a centrifuge cartridge at the bottom of the laundry drum and in that the centrifuge cartridge is removable and/or has at least one inlet opening and at least one outlet opening for the washing liquid at the rear side of the centrifuge cartridge.

12. A method for washing textiles using the washing machine according to claim 1, in which textiles are washed in the laundry drum in the washing liquid in the tub, in which the washing liquid is channelled from the tub via the discharge line into the intermediate storage container after washing, in which the washing liquid is channelled at least partially from the intermediate storage device container via the return line into the centrifuge container, in which the centrifuge container is rotated together with the laundry drum, in which microplastic fibres are separated from the washing liquid in the centrifugal force direction during rotation in the centrifuge container, and in which a cleaned washing fluid is discharged into a space between the tub and the drum.

13. The method according to claim 12, in which the separation of the microplastic fibres from the washing liquid takes place by rotating the laundry drum when spinning the textiles in the laundry drum and/or in which the separated microplastic fibres remain in the washing machine after washing the textiles.

14. The method according to claim 12, in which the cleaned washing fluid flows out of the centrifuge container via a weir-like overflow as overflow liquid and/or in which residual liquid not flowing out via the overflow after the separation of the microplastic fibres drains as residual liquid from the centrifuge container via a residual liquid drain, in particular a residual liquid flap.

* * * * *